US006582478B1

(12) United States Patent
Van Wersch

(10) Patent No.: US 6,582,478 B1
(45) Date of Patent: Jun. 24, 2003

(54) PROCESS FOR PREPARATIVE AND REACTIVE DYEING OF CELLULOSE MATERIAL

(75) Inventor: Kurt Van Wersch, Wegberg (DE)

(73) Assignee: A. Monforts Textilmaschinen GmbH & Co., Monchengladbach (DE)

( * ) Notice: Subject to any disclaimer, the term of this patent is extended or adjusted under 35 U.S.C. 154(b) by 0 days.

(21) Appl. No.: 09/787,563

(22) PCT Filed: Sep. 9, 1999

(86) PCT No.: PCT/DE99/02903

§ 371 (c)(1),
(2), (4) Date: Jun. 13, 2001

(87) PCT Pub. No.: WO00/17437

PCT Pub. Date: Mar. 30, 2000

(30) Foreign Application Priority Data

Sep. 19, 1998 (DE) ..... 198 43 047
Sep. 19, 1998 (DE) ..... 198 43 046

(51) Int. Cl.[7] ..... D06L 3/04; D06P 3/66

(52) U.S. Cl. ..... 8/543; 8/111; 8/149.3; 8/151; 8/931

(58) Field of Search ..... 8/111, 543, 149.3, 8/151, 931; 68/5 D, 5 E

(56) References Cited

U.S. PATENT DOCUMENTS

| | | | | |
|---|---|---|---|---|
| 5,071,439 | A | * | 12/1991 | Weible |
| 5,378,245 | A | | 1/1995 | Balland |
| 5,885,305 | A | * | 3/1999 | Van Wersch |

FOREIGN PATENT DOCUMENTS

| | | |
|---|---|---|
| CN | 560 789 | 4/1975 |
| DE | 39 06 769 | 9/1990 |
| JP | 05 071082 | 3/1993 |
| WO | WO97/14839 | 4/1997 |

* cited by examiner

*Primary Examiner*—Margaret Einsmann
(74) *Attorney, Agent, or Firm*—Collard & Roe, P.C.

(57) ABSTRACT

The invention relates to a process for preparative and reactive dyeing of cellulose material. In order to shorten the process time of conventional preparing agents and continuous operation, to make superfluous neutralizing agents for removing excess peroxy compounds as well as to reduce the mechanical equipment required vis-à-vis prior art and to reduce the use of chemical agents, the cellulose material soaked with the treatment liquor is continuously dried with pulsated air at approximately the same disintegration rate as the peroxy compounds thus used. Alkali remaining in the material from pretreatment which remained in the material is used for dyefixing said material.

9 Claims, 2 Drawing Sheets

PROCESS FOR PREPARATIVE AND REACTIVE DYEING OF CELLULOSE MATERIAL

CROSS REFERENCE TO RELATED APPLICATIONS

Applicant claims priority under 35 U.S.C. §119 of German Application Nos. 198 43 046.9 and 198 43 047.7 both filed Sep. 19, 1998. Applicant also claims priority under 35 U.S.C. §120 of PCT/DE99/02903 filed Sep. 9, 1999. The international application under PCT article 21(2) was not published in English.

DESCRIPTION

The invention relates to a method for the pretreatment, specifically for the desizing and boiling off as well as bleaching, if need be, of cellulose materials, by which a treatment mixture of a pretreatment agent containing per-compounds such as hydrogen peroxide is applied to the cellulose material and caused to act as intended in the pretreatment. Furthermore, the invention relates to a method for applying the treatment agents in the reactive dyeing and dye fixation of cellulose material, by which the material is pretreated, specifically desized, boiled off and/or bleached before the dye is fixed.

The term "web-shaped cellulose material" is understood to relate to flat textile structures made of cellulose, including cotton, viscose, regenerated cellulose as well as its mixtures among each other, and/or made of synthetic fibers. The method is intended to be applied primarily in conjunction with flat textile structures such as woven or meshed textile structures; however, its application in connection with threads or ribbons of thread is possible as well. Suitable per-compounds, briefly "per", which split off oxygen in solution preferably by decomposition of hydrogen peroxide, within the meaning of the invention are, for example perborates or percarbonates. The respective treating agent is preferably applied by immersion in a bath containing the treatment agent.

The process steps desizing and boiling off as well as bleaching, if need be, are part of the preparation process, the so-called "pretreatment" in the finishing of textiles. The purpose of desizing is to remove all substances that were previously applied to the fiber in the sizing process. Various methods of desizing are available that conform to the sizing agents employed in the given case. Starch-containing sizing agents can be desized with the help of enzymes; in other cases, oxidative desizing is required. The natural impurities of cotton such as fat, waxes, pectins etc. render such a cellulose product hydrophobic and are therefore removed as "dirt" in a generally alkaline boiling-off process, for example with sodium peroxide.

Following desizing and, if need be, boiling off, many textiles have a undefined yellowish color impression that is often removed prior to subsequent dyeing by bleaching if a defined color shade is to be obtained. In the treatment of cotton and other native as well as regenerated cellulose fibers, hydrogen peroxide bleaches, among other things, are almost always used in conjunction with sodium hydroxide and other chemicals.

In many of the known desizing, boiling-off and bleaching processes, a separate plant, for example a desizing, a boil-off and a bleaching plant is required for each of the process stages. Such plants are frequently not operated continuously because dwelling times of several hours are to some extent required for permitting the respective chemical to act. The expenditure in terms of machines, space and operating costs is consequently substantial. Another drawback is the time expenditure of at least 1 hour needed in most cases in connection with the usual dwelling times. If the work is carried out at high temperatures in order to reduce the process, the energy costs rise accordingly.

A combined desizing, washing and bleaching process for raw textiles made of cotton, which is carried out continuously, is described in CH 560 789. In said process, the cellulose material is wetted with an aqueous solution that contains as important components alkali metal hydroxide as well as per-compounds such as hydrogen peroxide and peroxide phosphate. The material is heated to a treatment temperature of about 80° to 135° C. At treatment temperatures of 100° C. and normal pressure, the treatment vessel contains 100% by vol. steam. At the temperature limit of 80° and normal pressure, which is specified in the prior art, almost 100% by vol. steam is reached in the treatment vessel as well. Following the heat treatment, the material is washed. Short treatment times of down to 1 minute are possible only at 135° C. and 100% by vol. steam in the pressure vessel and consequently only discontinuously.

During the known steam treatment of the material loaded with the pretreatment agent at approximately 100% by vol. steam, the moisture content of such material is maintained approximately constant in accordance with the steam content of the treatment chamber. However, the per-compounds, in particular hydrogen peroxide, contained in the pretreating agent decompose during that time in accordance with the relatively high temperature. As a result, the content of per-compounds in the (approximately constantly moist) textile material is constantly reduced. As the concentration of the per-compounds decreases, their desired pretreatment effect (per time unit) is diminished as well. Therefore, in the known art it is necessary to work with relative high excess amounts of per-compounds. According to CH 560 789, substantial treatment times are nonetheless needed if the work is not to be carried out discontinuously in pressure vessels at temperatures of close to 135° C.

However, in the steam atmosphere (100% by vol. steam) for which provision is made in the aforementioned patent CH 560 789, the amount of per-compound used is not nearly completely degraded. This, however, is not permissible because the reactive effect of the per-compounds would otherwise increasingly drop toward the end of the pretreatment process (and the reaction time required for the pretreatment would become increasingly longer). Therefore, the per concentration still remains so high at the end of the pretreatment that the material has to be washed after the treatment has been completed. This applies specifically if such treatment is followed by a subsequent dyeing process because the dyestuff can be damaged by per-substances.

For a discontinuous peroxide bleaching step preceding the dyeing of cellulose material, it is proposed in DE 39 06 769 A1 to first add glyoxal or glyoxalic acid to the bath to be used for dyeing. Such substances are expected to neutralize those per compounds that remained on the material from the peroxide bleach, if possible without any interconnected washing step. The additional chemicals lead to contamination of the waste water accordingly.

A very similar process for dyeing in reactive dyestuffs after a bleaching process is disclosed in U.S. Pat. No. 5,378,245. The treatment bath used for bleaching contains hydrogen peroxide. The bath is permitted to act on the material for 45 to 60 minutes at 70 to 120° C. As in the aforementioned documents CH 560 789 and DE 39 06 769, the bleaching process thus takes place at almost 100% by vol. air humidity in the treatment chamber and without any drying of the material. The hydrogen peroxide components accordingly remaining on the material with the wet bleaching process used in the present case as well, are therefore neutralized with a reducing agent before the dye is applied in order to protect the dyes against the peroxide.

DE 31 24 961 A1 describes a discontinuous process for simultaneous dyeing and desizing. This is a cold-dwelling process in which dyes and desizing agent (amylase) as well as soda are added to the treatment bath. Following immersion and squeezing off and a bath absorption of about 70%, the textile material is rolled up and, wound in a plastic foil, stored for 24 hours at about 20° C. while slowly rotating. The material is subsequently passed through a boiling soap bath, among other things. If the material has to be bleached, the soap bath may contain the bleaching hydrogen peroxide because the simultaneous dyeing and desizing process cannot be combined with the bleaching step, as the bleaching agent would damage the dye.

In a process known from WO 97/14839 for fixing the dyestuff in a reactive dyeing process, the material impregnated with a dye bath containing the reactive dye is treated in an air dryer with atypically moist drying air. The moisture content and the dwelling time of the material in the air dryer are adjusted in such a way that the desired reaction of the dye with the cellulose fibers takes place while the material is passing through the dryer. In the known art, the air dryer is operated with the substantially steam-loaded drying air in order to achieve an optimal dyeing yield with minimal use of chemical adjuvants.

The invention is based on the problem of providing a pretreatment method that permits a continuous operation throughout; which substantially combines the pretreatment in a treatment aggregate, or type of aggregate; which does not require special neutralizing agents for eliminating residues of per-compounds, if any; and which requires—without excess pressure—shorter processing times for the treated textile material vis-à-vis the prior art. A further problem is to reduce the consumption of the overall amount of chemical adjuvants, in particular alkali substances required for the pretreatment and fixation of the dyestuff in the reactive dyeing process, without impairing the success of the pretreatment or the dyestuff yield.

The solution as defined by the invention for the method specified above for the pretreatment, in which per-compounds are employed, is described in claim 1. Decisive is in particular the fact that the per-compounds are expelled from the cellulose material by continuous drying with circulating air. A method of reactive dyeing and dye fixation in connection with cellulose material is also specified. A number of improvements and further developments of the invention are described in the dependent claims.

The achievement made possible by virtue of the invention is that the water content in the textile material during drying is reduced to about the same degree and thus at about the same rate as the proportion of per-compounds, in particular hydrogen peroxide is decomposed or consumed at the respective treatment temperature. This means that according to the invention, the concentration of the per-compounds in the bath that are still present in the material, is to be approximately constant. It is, in this conjunction, within the scope of the invention to control the rate of decomposition of the per-compounds, for example in accordance with the way in which such compounds are charged and/or in accordance with the treatment temperature, for example by adding stabilizers or destabilizers, in a way such that the rate of decomposition and the rate of drying are approximately the same up to close to about complete decomposition or consumption of the per-compounds. The relative effect of the per-compounds does practically not change throughout the entire actual pretreatment process because of their approximately constant concentration on the material. The actual pretreatment process, which can be followed by further drying of the material, can be considered completed once the per-compounds have completed their function.

Since the amount of water in the treatment bath absorbed by the material decreases, the effect of the other pretreatment substances, for example alkalis, which are only consumed in the course of the treatment but do not degrade on their own, practically even increases. The approximately constant per concentration and the alkali concentration, which may be increased under certain circumstances, etc., lead to the fact that with the procedure as defined by the invention, the pretreatment takes place substantially quicker than it does in connection with conventional methods.

Furthermore, the amount of per compounds used can be dimensioned in such a way that such per compounds, with approximately constant concentration on the material at the start, are consumed at the end of the pretreatment process down to an absolutely unnoticeable measure. Washing, for example prior to dyeing, because of any residues of the per-compound that might be present, is therefore not required. In the known art, on the other hand, washing or neutralizing has to be carried out because the concentration of per-compounds in the treatment bath contained within the material constantly decreases, and the per-compounds have to be added (at the start) in excess amounts if an effect is to be noticeable near the end of the process at all.

In general, the method as defined by the invention can be carried out if moist-hot, but not wet-hot drying air is used. The drying air employed according to the invention should contain only as much moisture as required for the drying rate of the material and the decomposition rate of the per-compound used to be approximately the same. A drying air satisfying these conditions is referred to as "moist-hot" within the scope of the invention.

The pretreatment as defined by the invention is preferably carried out in an air dryer operated with circulating air, whose "moist-hot" drying air has a steam content in particular in the order of magnitude of about 30% by vol. steam, which per se prolongs the drying rate. Said measure may vary considerably, for example by ±10% by vol. points. Therefore, provision is made for an atypically operated air dryer that is operated not in the usual way with as little water vapor content as possible, but rather with a relatively high water vapor content in the circulating air. However, the water vapor content should be adequately low for the constant drying to take place in the course of the treatment process, and a dwelling time within the circulating air of from 2 to 5 minutes will suffice for drying if the temperature of the circulating air is within the order of magnitude of 100° C. and higher.

The lower limit of the duration of the treatment of about 2 minutes specified above is defined by the time in which the component of per-compounds, e.g. hydrogen peroxide has been consumed or chemically decomposed to a measure that is no longer interfering, depending on the level of the treatment temperature. The upper limit of the treatment duration is determined by the quality, in particular by the weight of the treated material. With lightweight material, an overall treatment time that is about equal to the consumption or decomposition time of the per-compounds, may suffice. The actual pretreatment is completed once the minimum time specified above has elapsed. This means that if no further drying of the material is required, said pretreatment can be terminated.

According to the invention, a cellulose material loaded with a treatment bath containing pretreatment agents is to be continuously passed (generally following immersion in the pretreatment bath) through the moist-hot drying air and is there simultaneously desized, boiled off and, if need be, bleached by the moist heat acting on the pretreatment agents, with continuous drying of the material in spite of the moisture. All reactions desired in the course of the pretreatment for the possibly various types of pretreatment can be carried out at the same time in the moist hot drying air.

It was found to be favorable if all pretreatment agents are applied to the material at the same time in one single pretreatment agent bath. The cellulose material can be completely prepared in the moist-hot drying air for a continuously following dyeing process downstream. However, the bath containing the respective pretreatment agents can be applied to the cellulose material in a number of steps as well. This is preferably accomplished by continuously impregnating or immersing the material in one or several padding machines arranged one after the other and each followed by a calender downstream. An air passage providing in particular for a dwelling time of a few ten seconds can be interconnected between each two padding machines, for example for the purpose of superior wetting. The calendering effect can be adjusted in such a way that the material is received in the air dryer with the usual residual moisture values.

An advantageous device for carrying out the pretreatment method as defined by the invention comprises at least one treatment padding machine, an air dryer, as well as washing and drying plants. A chamber with a material inlet and outlet as well as with controllable exhaust-air volume, controllable circulating fan and with adjustable steam injection can be provided in the form of the air dryer, i.e. the latter being the pretreatment device. In the chamber, provision has to be made for a climate-measuring device. connected to controlling means for regulating the exhaust air volume and the steam injectors for adjusting a predetermined steam content in the circulating air.

It is within the scope of the invention if the drying chamber or air dryer also comprises two or more individual aggregates which, however, act as one single device in the result. The operation as defined by the invention in the air defined as moist-hot can be referred to as "steam drying". According to a preferred solution, such steam drying is carried out in a so-called hot flue.

The basis of the method as defined by the invention for the pretreatment of cellulose material is that the material, after having been acted upon by the respective treatment bath, dwells for a few minutes, e.g. 2 to 3 minutes, preferably in a padding machine, at 110° to 150° C. (depending on the weight of the material), with a steam content in the air of the dryer (with continuous passage through the latter) in the order of magnitude of 30% by volume. This suffices for a complete pretreatment of the cellulose material. No pressure vessel is required because of said relatively low water content, so that the process always can be carried out continuously.

It is surprisingly possible to basically employ the reactive dyestuff fixation device described in the aforementioned WO 97/14839 for carrying out the pretreatment method as defined by the invention. By adapting the treatment bath to the objectives of the pretreatment, and by drying the material at a rate approximately conforming to the consumption and decomposition rates of the per-compounds, it is principally possible to employ the known reactive dyeing device as the pretreatment device. Said solution is remarkable to the highest degree in that the numerous, partially discontinuously operating machines interconnected between the padding machine and the washing machine in the known pretreatment installations are replaced by one single type of machine, namely the air dryer. Based on the temperature, the pretreatment as defined by the invention is carried out in this conjunction at a substantially higher processing rate than ever known before, and in continuous manner throughout. The amount of per-compounds used practically acts until the last moment of the actual pretreatment process with (based on the material) an absolutely almost unchanged reaction rate. Neutralizing agents (acting against the per-compounds) are not required.

According to the further invention, a method for applying the treatment agents in the reactive dyeing and dye fixation of cellulose material, in which the material is desized and boiled off and, if need be, bleached, or briefly pretreated, consists in that the material received from the pretreatment stage is impregnated in the unwashed condition with a reactive dyestuff bath and the dye is then fixed. Said part of the invention can be referred to as the "dyeing part" in order to distinguish it from the first part, which is the "pretreatment part".

As a rule and preferably, the pretreatment part as defined by the invention and the dyeing part as defined by the invention are combined in a plant installation through which the material is passed continuously. If need be, the dyeing part can be set up between the air dryer and the washing plant of the pretreatment part. However, an independent application may be basically advantageous within the scope of the invention as well, that is to say, after the pretreatment part, the material can be washed as well as possibly dried and processed or treated further in some other (known) way. The dyeing part of the invention, too, may follow some conventional pretreatment plant upstream and exploit alkali residues originating from the previous stage, as long as no interfering per-compound residues are left over (in the material to be dyed).

In the dyeing part of the invention, the chemical substances, particularly alkali, supplied for the pretreatment process and still present in the material when the latter exits from the pretreatment stage, are employed for the mechanism of the reaction in the reactive dye fixation process. This means that in the dyeing part, the substances and excess treatment agents detached from the material in the pretreatment part of the invention can remain on the material and can be washed out only at the end of the dye fixation process to the extent such substances and agents were not consumed already in the dye fixation process. Finally, therefore, the material coming from the pretreatment stage can be continuously and directly passed into the reactive dyestuff bath in the "as-is" condition, possibly also undried, if need be. However, the bath carried along from the pretreatment stage may no longer contain any amounts of per-compounds damaging the dyestuffs.

The core of the dyeing part of the solution as defined by the invention consists in that the chemical substances—with exception of the per-compounds—already applied for or during the pretreatment are employed not only for the physico-chemical process taking place in the pretreatment stage, but are used a second time during the fixation of the reactive dyestuff.

In the dyeing part of the invention, the (pretreated and unwashed) material, when it comes into contact with the reactive dyestuff bath, already contains the alkali etc. required for the chemical process of dyestuff fixation carried out in the device according to the aforementioned WO 97/14839. Such alkali may be diluted in the material in the preceding pretreatment; however, even a weak alkali suffices for the dyestuff fixation process. In the washing process (followed by drying, as a rule) following the reactive dye fixation process, excess amounts of treatment agents and reaction products such as dirt, including any residual amounts of alkali, originating from both the pretreatment stage and the dyeing stage are separated.

Since the amounts of alkali or the like used in the pretreatment part according to the invention are caused to act also in the dye fixation process, the amount of chemical adjuvants that have to be added to the respective dyestuff bath, is substantially reduced. The amounts of alkali etc. loading the waste water are substantially reduced because of such double function.

However, the dyeing part of the invention still offers an additional advantage because if not only the washing step conventionally following the pretreatment but also the drying step can be dispensed with, equipment and energy expenditures are saved accordingly. A joint washing and drying plant is then associated with the pretreatment and dyeing stages. Therefore, in addition to the advantage of saved amounts of alkali and reduced contamination of the waste water, the benefits of reduced equipment expenditure (a complete washing and drying plant is omitted) and accordingly reduced energy expenditure are gained.

A few details of the invention are explained in the following with the help of the schematic representation of an exemplified embodiment. In the drawing, FIG. 1 shows an overall pretreatment installation as defined by the invention.

Figure 1:
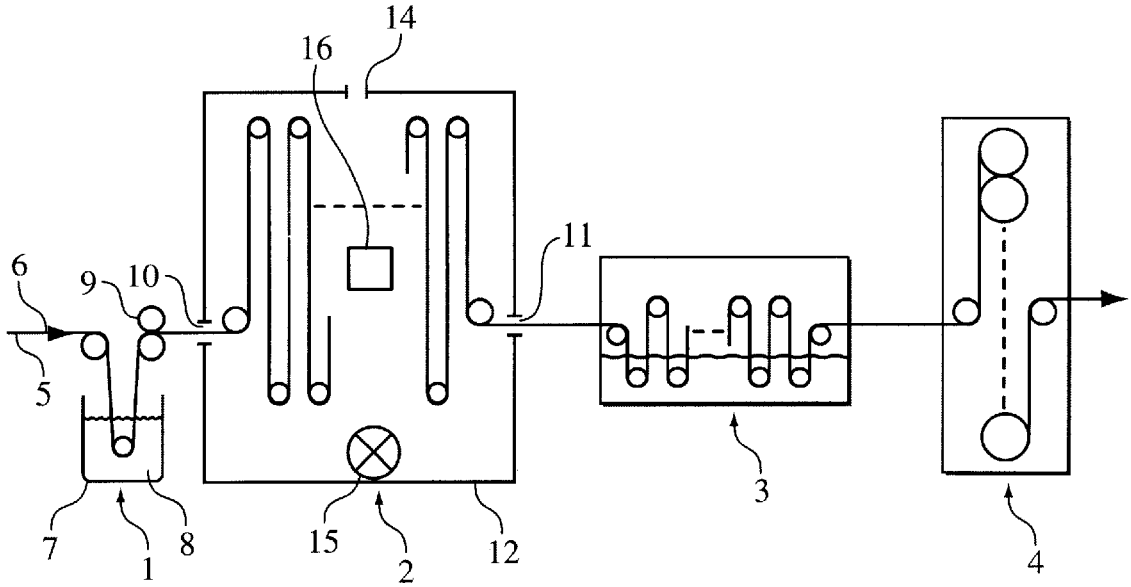

According to FIG. 1, an installation as defined by the invention for the pretreatment of cellulose material, for example terry cloth, may basically comprise four aggregates, specifically a padding machine 1 for the metered application of a pretreatment bath to the material, a hot flue 2 for steam-drying the material loaded in the padding machine, a washing plant 3 located downstream of the hot flue 2, and a drying plant, e.g. a hot flue, a cylinder dryer or a stretching frame, following the washing plant downstream. The web-shaped cellulose material 5 to be treated has to continuously pass through said aggregates 1 to 4 in the transport direction 6.

First, in the padding machine 1, the material 5 is immersed in a pretreatment bath 7 present in the bath vat 8, said bath being of the type usually employed for desizing, boiling off and bleaching. From the bath 7, the material travels via a mangle 9 into the hot flue 2, where provision is made with the help of known measures as described, for example in WO 97/14839, that after exiting from the mangle, the material 5 loaded with, for example 100% residual moisture, is maintained from the material inlet 10 to the material outlet 11 of the chamber 12 of the hot flue "moist hot" in such a condition that the systems "material", on the one hand, and "applied pretreatment bath" on the other, remain ready for the reaction in the desizing, boiling-off and bleaching processes, which means that in the course of the actual pretreatment process, the drying rate of the material is approximately equal to the decomposition rate of the per-compounds.

Figure 2:
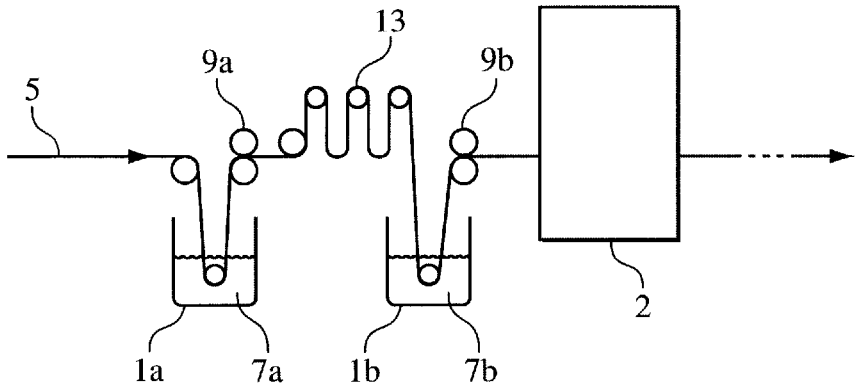
FIG. 2 shows a modification of the equipment according to FIG. 1.

If the individual pretreatment agents may not or must not be mixed with each other in one single treatment vat, or if adequate wetting of a material by passing it immersed through one single padding machine poses problems at the processing speed desired in the given case, it may be favorable according to FIG. 2 to connect two or more padders 1*a* and 1*b* one after the other and to guide the material 5 through a mangle 9*a* and 9*b* after exiting from the pretreatment bath 7*a* and 7*b,* respectively. Dehydration is then preferably carried out to a greater extent in the first mangle 9*a* than in the second mangle 9*b,* so that as little pretreatment bath 7*a* as possible is carried from the first vat 1*a* into the bath 7*b* of the second vat 1*b*. An air passage 13, for example providing for a dwelling time of from 20 to 40 seconds, may be interconnected between the two padders 1*a* and 1*b* in order to permit the pretreatment bath of the first vat 1*a* to act before the material 5 runs into the second vat 1*b*.

As basically shown in FIG. 1, it may be favorable for carrying out the method as defined by the invention if the chamber 12 of the air dryer 2 is equipped with a controllable exhaust suction channel 14 as well as with the controllable steam injectors 15, and if a climate-measuring device 16 is arranged in the chamber, such measuring device being connected to the means for controlling the exhaust suction channel 14 (volume of the exhaust air) and the steam injectors 15. In this way, it is possible to adjust a preset minimum steam content of the circulating moist-hot air.

Figure 3:
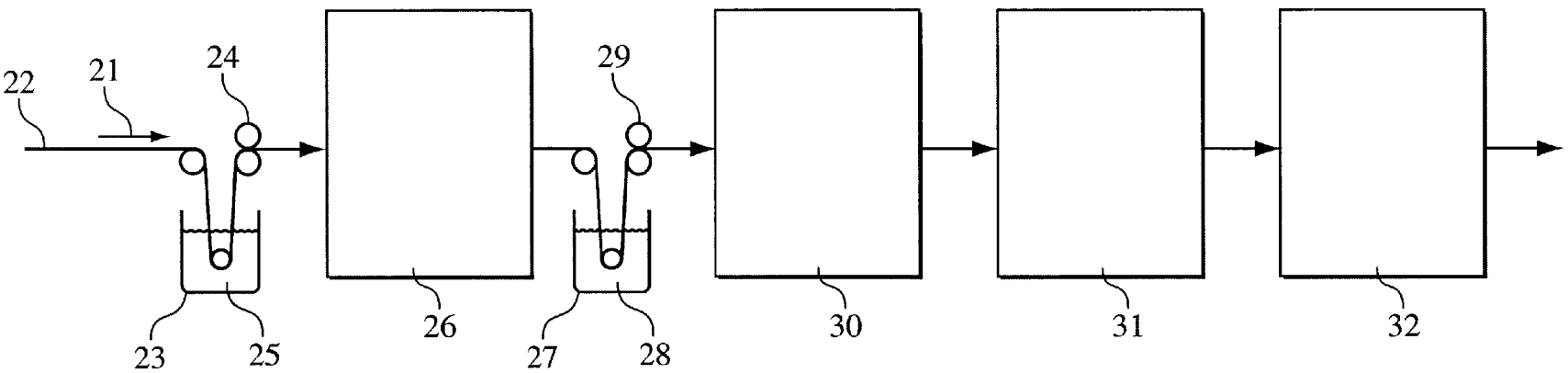
FIG. 3 shows a pretreatment plant with a continuously following dyeing plant.

FIG. 3 explains the principle of a combined pretreatment and dyeing installation as defined by the invention. A web-shaped cellulose material 22 moving in the transport direction 21 is passed through a pretreatment agent applicator device symbolized as the padding machine 23, with a mangle 24 located downstream of the latter. Said applicator device can be designed like in the pretreatment part as defined by the invention, for example like in FIG. 1 or 2, or it may be realized also in the conventional manner, in which case it comprises one or more stages for applying the respective pretreatment agent 25 to the material 22. Pretreatment agents containing alkali particularly in the form of sodium hydroxide or the like alkali compounds, are employed for desizing, boiling-off and/or bleaching. An addition of alkali is required for the active physico-chemical system of the pretreatment, as a rule. The material 22 loaded in the padding machine 23 in the described manner is then received in some type of a single- or multi-stage pretreatment plant, but preferably in the pretreatment installation 26 as defined by the invention.

The material 22 pretreated in the installation 26 or the like is then passed into a dye applicator, which is symbolized in the drawing by the padding machine 27 with the dye bath 28 and the mangle 20 located downstream. In the dyeing part of the method as defined by the invention, the dye bath 28 contains the reactive dyestuff (and wetting agent, if necessary). However, no fresh alkali is required. The alkali (possibly including other chemical adjuvants) required for the reaction in the dye fixation equipment 30 downstream should deliver the material from the pretreatment installation 26 already in the form of a reaction residue (conventionally to be washed out). However, no residues of per-compounds should be present any longer in the material.

Therefore, when the material 22 exits from the second padding machine 27 via the mangle 29 in the direction of the dye fixation equipment 30, it is loaded also with the reactive dye bath (metered) in addition to the substances that remained from or originated in the pretreatment process. The dye fixation accordingly takes place with the utilization of the alkali etc. already used previously (in the pretreatment).

The dye fixation can be followed by a washing plant 31, for example the washing plant 3 of FIG. 1, where, if necessary, all substances that could interfere with the further finishing of the material 22 are washed out. This includes in particular the dissolved or converted sizing agents, released dirt, excess dyestuff, and the unused or converted adjuvants. The material 22 purified in the washing plant 31 may finally pass through a dryer 32 and can then be admitted to further processing, or it can be stored.

What is claimed is:

1. A method of pretreating web-shaped cellulose material for reactive dyeing comprising applying a treatment bath with a pretreatment agent containing per-compounds to the cellulose material to act in the material within the pretreatment process, drying the cellulose material approximately at the rate conforming to the decomposition rate of the per-compounds used, and maintaining the concentration of the per-compounds in the treatment bath still present on the cellulose material approximately constant accordingly.

2. The method according to claim 1, comprising blowing the cellulose material with circulating air and continuously moving said cellulose material in the process.

3. The method according to claim 2, comprising adjusting an air humidity still adequate for maintaining within the pretreatment process a material moisture ready for the reactive dyeing.

4. The method according to claim 1, comprising adding a stabilizer or destabilizer to the pretreatment agent for improving the synchronism of the drying and decomposition rates.

5. The method according to claim 1, comprising continuously drying the cellulose material in an air dryer for maintaining a residual moisture within the pretreatment ready for the reactive dyeing, with a steam content in the order of magnitude of 25% by vol., and carrying out such drying until the amounts of per-compounds contained in the material are consumed or decomposed.

6. A method for applying the treatment agents during reactive dyeing and dye fixation of cellulose material comprising pretreating the material according to claim 1 continuously in a circulating air dryer, impregnating the unwashed material coming from the pretreatment with reactive dyestuff bath and then fixing the dyestuff.

7. The method according to claim 6, wherein the substances employed for the pretreatment are selected so they may be re-used in the dye fixation.

8. The method according to claim 6, wherein chemical substances supplied for the pretreatment comprise alkali compounds that are still present and active, and are not neutralized in the cellulose material at the end of the pretreatment process, and are used for the reaction mechanism during the dyestuff fixation.

9. The method according to claim 5, wherein the substances and excess treatment agents detached from the material during the pretreatment remain on the material during the dye fixation and are washed out only at the end of the dye fixation to the extent such substances and excess treatment agents have not been consumed during the dyestuff fixation.

* * * * *